US007458480B2

(12) United States Patent
Nguyen

(10) Patent No.: US 7,458,480 B2
(45) Date of Patent: Dec. 2, 2008

(54) DISPOSABLE BABY DIAPER CONTAINER

(76) Inventor: Thuan Thien Nguyen, 3604 Riverhaven St., Pasco, WA (US) 99301

( * ) Notice: Subject to any disclaimer, the term of this patent is extended or adjusted under 35 U.S.C. 154(b) by 569 days.

(21) Appl. No.: 11/135,102

(22) Filed: May 23, 2005

(65) Prior Publication Data

US 2006/0261074 A1 Nov. 23, 2006

(51) Int. Cl.

| | |
|---|---|
| ***B65D 6/16*** | (2006.01) |
| ***B65D 8/14*** | (2006.01) |
| ***B65D 8/18*** | (2006.01) |
| ***B65D 90/02*** | (2006.01) |

(52) U.S. Cl. ..... 220/666; 220/359.1; 220/904

(58) Field of Classification Search ..... 220/359.1, 220/359.2, 666, 667, 833, 904; 229/101
See application file for complete search history.

(56) References Cited

U.S. PATENT DOCUMENTS

| | | | | |
|---|---|---|---|---|
| 1,808,833 | A | 6/1931 | Brack | |
| 3,280,871 | A | 10/1966 | Taylor | |
| 3,353,700 | A | 11/1967 | Kalina | |
| 3,872,994 | A | 3/1975 | Hyde | |
| 3,939,888 | A * | 2/1976 | Scarnato | 220/666 |
| 5,158,199 | A | 10/1992 | Pontius | |
| 5,209,372 | A | 5/1993 | Norwood | |
| 5,348,173 | A | 9/1994 | Norwood | |
| 5,417,337 | A * | 5/1995 | Robbins, III | 220/8 |
| 5,960,983 | A * | 10/1999 | Chan | 220/666 |
| 5,975,411 | A | 11/1999 | Windolph, III | |
| 6,412,652 | B1 * | 7/2002 | Woram et al. | 220/521 |
| 6,520,365 | B2 * | 2/2003 | Schneider | 220/9.2 |
| 6,554,149 | B2 * | 4/2003 | Schneider et al. | 220/9.3 |
| 6,702,143 | B2 * | 3/2004 | Wang | 220/666 |
| 6,736,285 | B2 * | 5/2004 | Stewart-Stand | 220/666 |

* cited by examiner

*Primary Examiner*—Anthony D Stashick
*Assistant Examiner*—Harry A Grosso
(74) *Attorney, Agent, or Firm*—Floyd E. Ivey

(57) ABSTRACT

A collapsible container having a sealed bottom and a sealable top. The sealable top having a peelable ring peelably adhering to a top ring. The top ring affixed to the container top at a perimeter. The peelable ring removable allowing a top lid to be affixed to the adhesive at the top ring. The adhesive containing a pleasant fragrance. The expanded container receiving a soiled diaper.

2 Claims, 4 Drawing Sheets

DISPOSABLE BABY DIAPER CONTAINER

FIELD OF THE INVENTION

This invention relates to disposal and containment of malodorous materials. The invention more specifically relates to an apparatus for containing and disposal of soiled baby diapers.

BACKGROUND OF THE INVENTION

Containers for the storage of baby diapers and other malodorous materials are known including U.S. Pat. No. 5,158,199 to Pontius. Collapsible containers are known including U.S. Pat. No. 1,808,833 to Brack; U.S. Pat. No. 3,280,871 to Taylor; U.S. Pat. No. 3,353,700 to Kalina; U.S. Pat. No. 3,872,994 to Hyde; U.S. Pat. Nos. 5,209,372 and 5,348,173 to Norwood; and U.S. Pat. No. 5,975,411 to Windolph, III. Adhesive coated strips having peelable coverings are known including U.S. Pat. No. 2,823,672 to Schladermundt et al.

The patents referred to herein are provided herewith in an Information Disclosure Statement in accordance with 37 CFR 1.97.

SUMMARY OF THE INVENTION

The need to dispose of soiled baby diapers is addressed by this invention. The invention provides a temporary disposable apparatus comprised of a collapsible container having a sealed bottom and a sealable top. The sealable top having a peelable ring peelably adhering to a top ring. The top ring affixed to the container top at a perimeter. The peelable ring removable allowing a top lid to be affixed to the adhesive at the top ring. The adhesive containing a pleasant fragrance.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
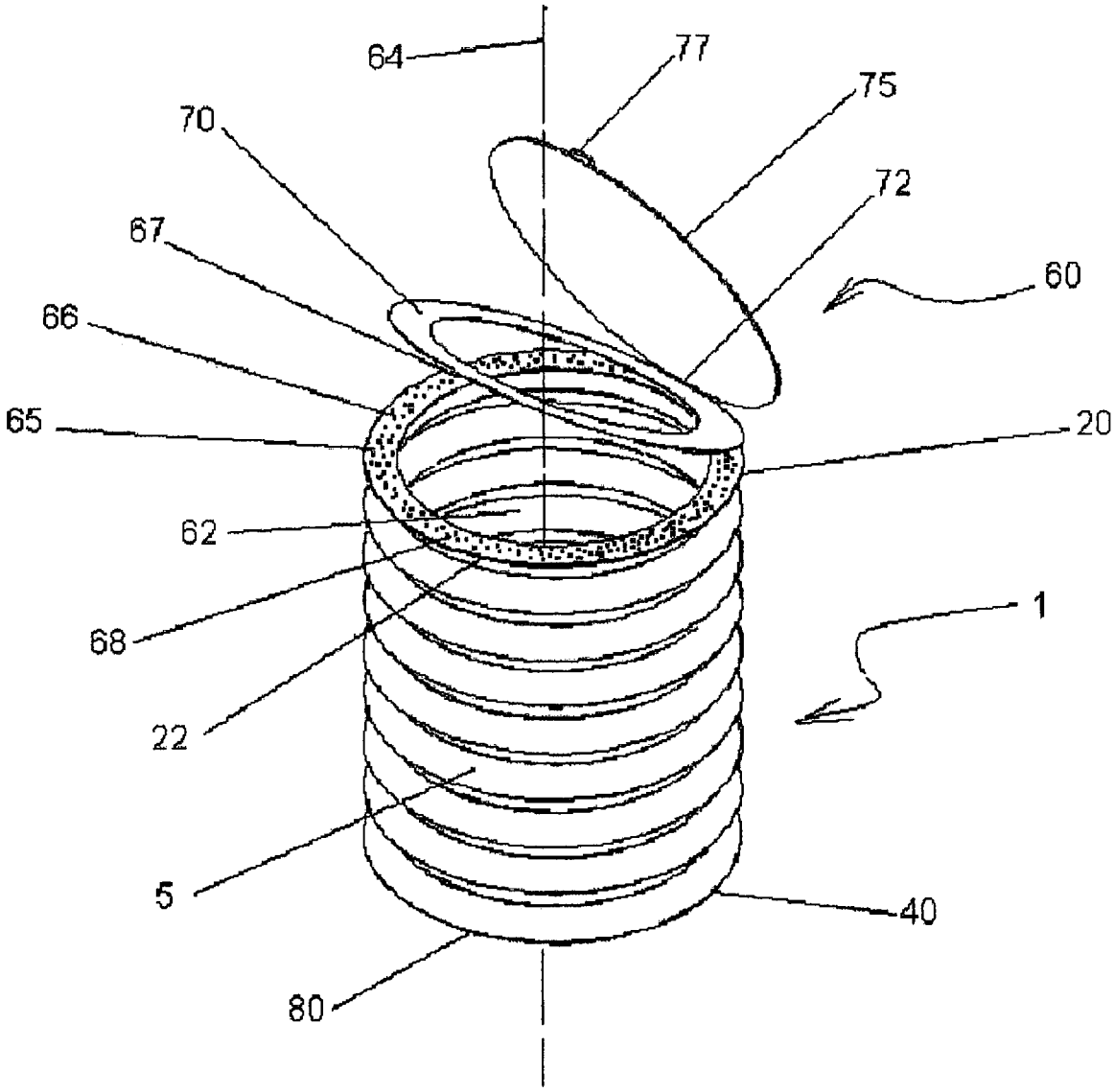
FIG. 1 is a front perspective showing the expanded container (1) formed as a foldable form (5) and illustrated as a collapsible accordion, spiral or bellows (5) form; a container top end (20) and a container bottom end (40), a top sealable lid means (60) at the container top end (20), a bottom sealed or sealable lid means (80) at the container bottom, a container top opening (62) at the container top end (20), a container axis (64),a substantially planar top ring (65), a perimeter (22) at the container top end (20), an adhesive means (66) is at the planar top ring (65), a planar peelable ring (70), a ring hinge means (72), a peelable lifting means (67), a generally planar top lid (75), a top lid lifting means (77), a fragrance means (68).
Figure 2:
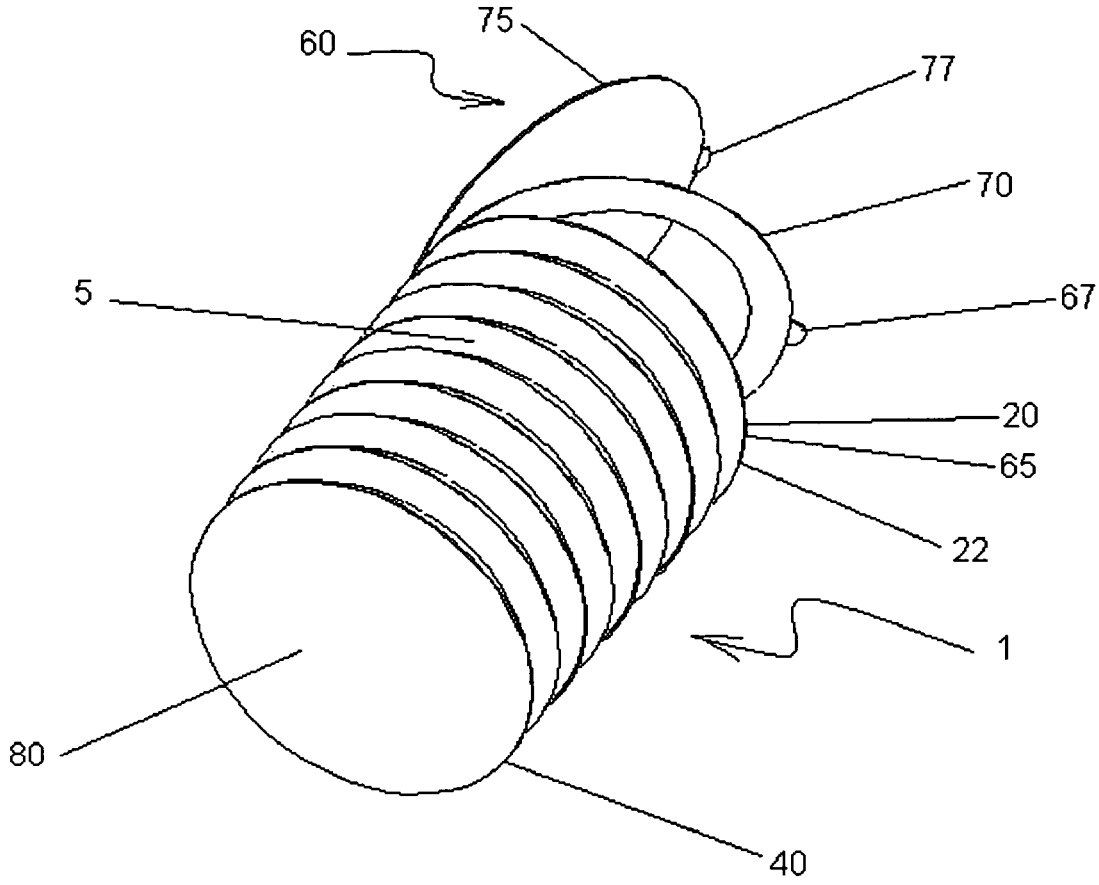
FIG. 2 is a perspective view of the container (1) viewed from the bottom end (40).
Figure 3:
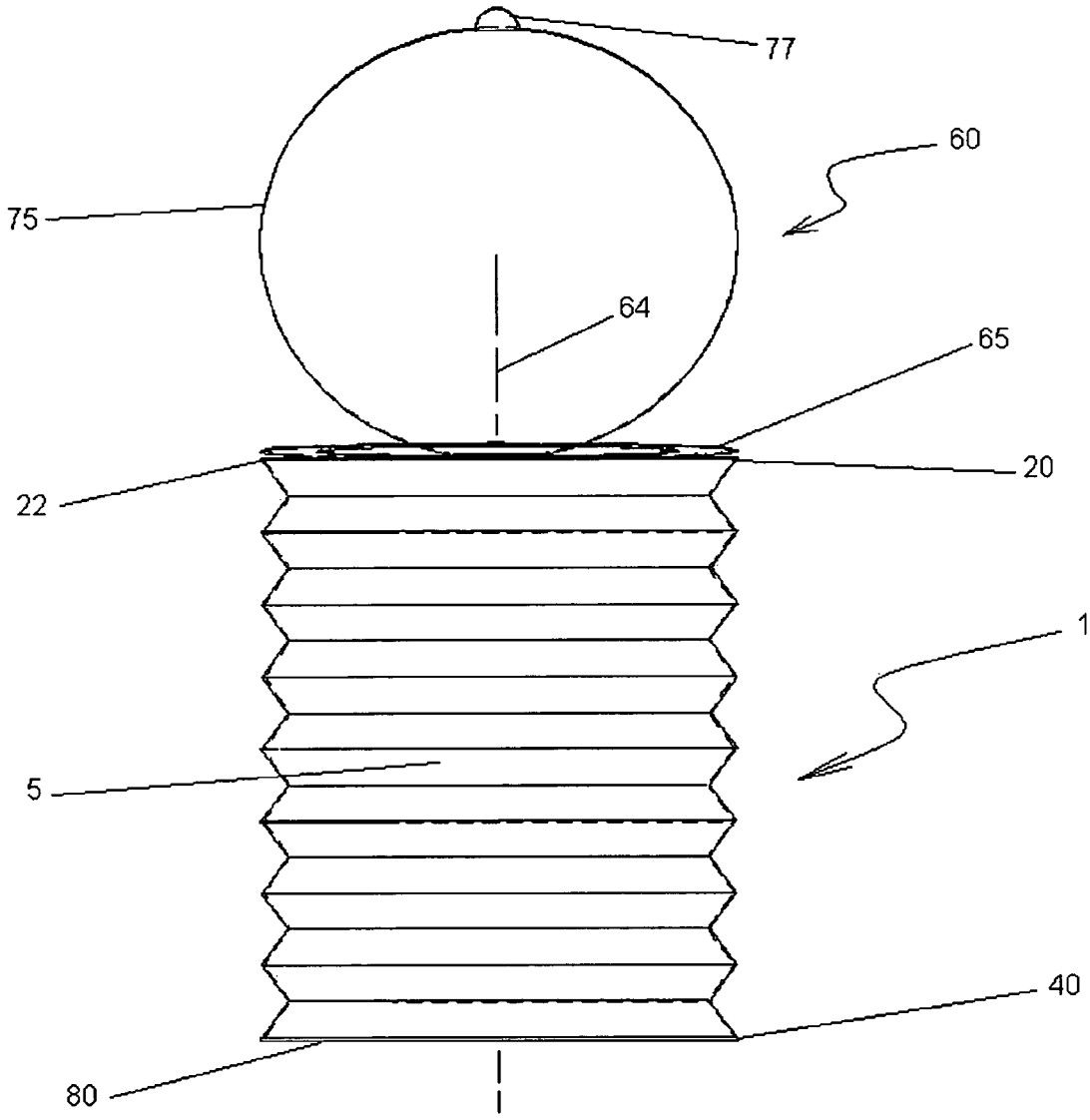
FIG. 3 is a front elevation of the container (1).
Figure 4:
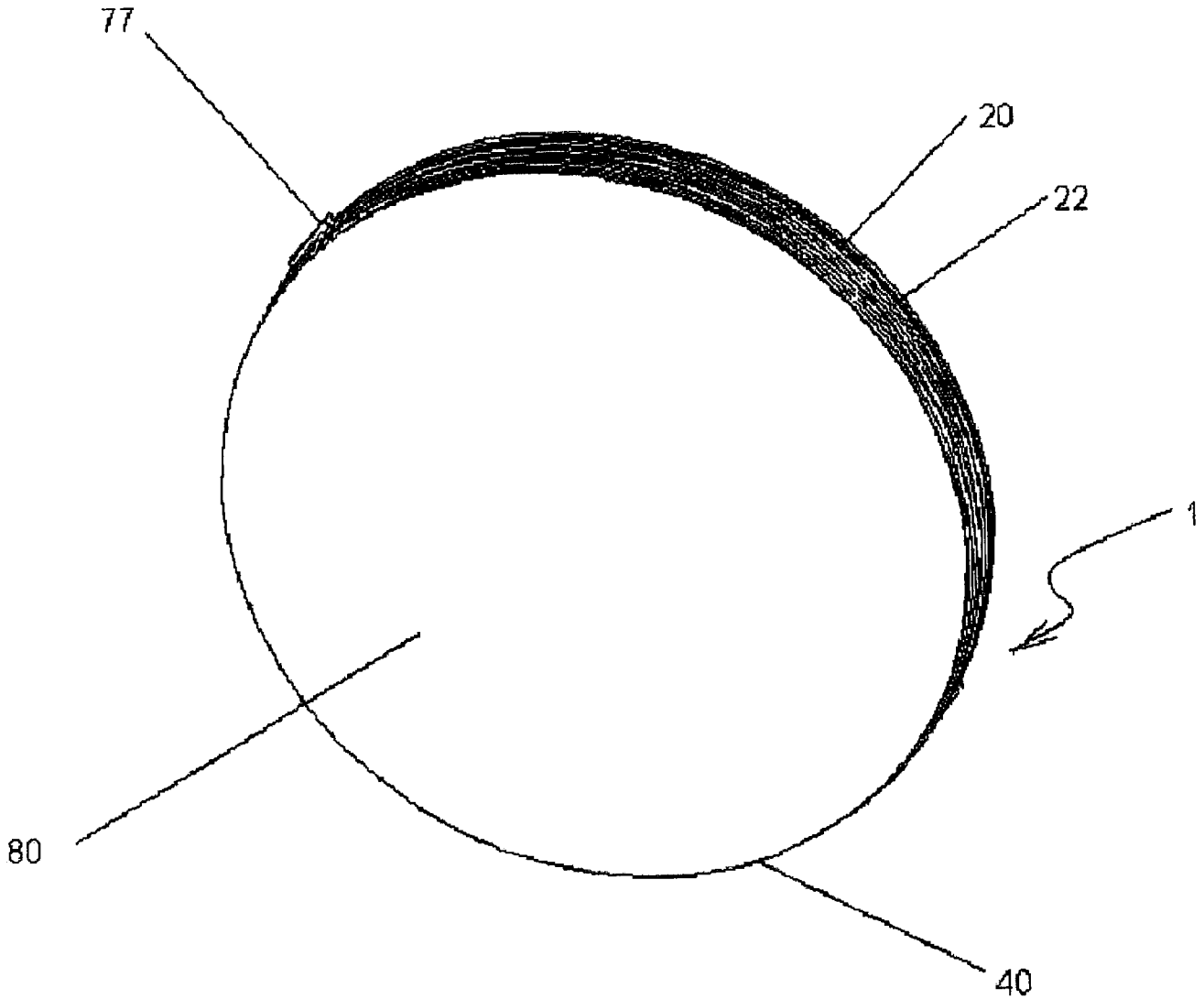
FIG. 4 is a view of the container (1) in the collapsed position.

FIGS. 1, 2, 3 and 4 illustrate the disposable baby diaper container (1) showing a cylindrical collapsible foldable container (1) having a container top end (20) and a container bottom end (40); seen is a top sealable lid means (60) at the container top end (20) and a bottom sealed or sealable lid means (80) at the container bottom. In the preferred embodiment the collapsible foldable container (1) is formed as a collapsible spiral or bellows (5). However, other collapsible and foldable means may be employed. It will be appreciated that the cylindrical collapsible foldable container (1) may have a variety of cross-sections including circular, oval, rectangular and polygonal. A container top opening (62) at the container top end (20) allows the insertion of a soiled baby diaper when the container (1) is expanded. A container axis (64) is centrally positioned from the bottom (40) to the container top (20) as a means of orienting the components of the top sealable lid means (60). The bottom sealed or sealable lid means (80) at the container bottom is substantially planar bottom lid (80) covering the spiral or bellows (5) container at the bottom (40).

The top sealable lid means (60) is comprised of a substantially planar top ring (65) having at a perimeter (22) at the container top end (20); the planar top ring (65) is substantially parallel with the bottom lid (80) and is substantially orthogonal with the axis (64); the planar top ring (65) is immovably affixed by top ring (65) affixing means to the bellows (5) at the container top end (20); an adhesive means (66) is applied to the planar top ring (65) distal to the bellows (5) and distal to the container top end (20). Top ring (65) affixing means may be by adhesives or mechanical means such as stapling.

A generally planar peelable ring (70) proximal the top ring (65) and distal to the container (1) or spiral or bellows (5) container, is affixed by a ring hinge means (72) to the top ring (65); the peelable ring (70) peelably adhering to the adhesive means (66) at the top ring (65). A generally planar top lid (75) is shaped to cover the container top opening (62). The peelable ring (70) is intermediate the top lid (75) and the top ring (65) and the top lid (75) is affixed by a ring hinge means (72) coincident with the affixing of the peelable ring (70). Ring hinge means (72) may be by adhesive, adhesive tape or by mechanical means including stapling. The peelable ring (70) has a peelable ring lifting means (67) comprised, in the preferred embodiment, of a generally planar tab extending from the peelable ring (70) proximal the perimeter (22). The top lid (75) has a top lid lifting means (77) comprised, in the preferred embodiment, of a generally planar tab extending from the top lid (75) proximal the perimeter (22). Said peelable ring lifting means (67) and or top lid lifting means (77) may be formed as an integral part of the peelable ring (70) or the top lid (75) or may be affixed thereto via lifting means adhesive means or mechanical means. The top lid (75) is generally planar.

The peelable ring is composed of glossy paper or thin plastic such as polyethylene or other such material that will allow temporary adherence to an adhesive surface with removal leaving the adhesive to adhere to another surface. The peelable ring (70) is removable and disposable allowing the top lid (75) to contact the top ring (65) and to be sealably affixed to the top ring (65). In the preferred embodiment the adhesive means at the top ring (65) has a fragrance means (68) which is released upon removal of the peelable ring (70).

The container (1) is formed of a moisture proof flexible or semiflexible foldable material including cloth, paper, wax paper, plastics and other such materials.

While a preferred embodiment of the present invention has been shown and described, it will be apparent to those skilled in the art that many changes and modifications may be made without departing from the invention in its broader aspects.

The appended claims are therefore intended to cover all such changes and modifications as fall within the true spirit and scope of the invention.

I claim:

1. A disposable baby diaper container comprising:

a. a collapsible foldable container (1) having a container top end (20) and a container bottom end (40);

b. a top sealable lid means (60) at the container top end (20);

c. a bottom sealed or sealable lid means (80) at the container bottom;

d. the collapsible foldable container (1) formed as an accordion, spiral, bellows or other foldable form (5);

e. a container top opening (62) at the container top end (20);

f. the foldable form (5) is collapsible and expandable; a container axis (64) centrally positioned from the bottom (40) to the container top (20);

g. the bottom sealed or sealable lid means (80) at the container bottom is substantially planar bottom lid (80) covering the foldable form (5) at the bottom (40);

h. the top sealable lid means (60) is comprised of a substantially planar top ring (65) having at a perimeter (22) at the container top end (20); the planar top ring (65) is substantially parallel with the bottom lid (80) and is substantially orthogonal with the axis (64); the planar top ring (65) is immovably affixed by top ring (65) affixing means to the foldable form (5) at the container top end (20); an adhesive means (66) is applied to the planar top ring (65) distal to the foldable form (5) and distal to the container top end (20);

I. a generally planar peelable ring (70) proximal the top ring (65) and distal to the foldable form (5); the planar peelable ring (70) is affixed by a ring hinge means (72) to the top ring (65); the peelable ring (70) peelably adhering to the adhesive means (66) at the top ring (65);

j. a generally planar top lid (75) covering the container top opening (62); the peelable ring (70) is intermediate the top lid (75) and the top ring (65); the top lid (75) is affixed by a ring hinge means (72) coincident with the affixing of the peelable ring (70);

k. the peelable ring (70) has a peelable ring lifting means (67) proximal the perimeter (22); the top lid (75) has a top lid lifting means (77) proximal the perimeter (22).

2. A disposable baby diaper container (1) of claim 1 further comprising:

a. the peelable ring composed of glossy paper or thin plastic such as polyethylene; the peelable ring (70) is removable and disposable allowing the top lid (75) to contact the top ring (65) and to be sealably affixed to the top ring (65);

b. the adhesive means at the top ring (65) having a fragrance means (68) which is released upon removal of the peelable ring (70);

c. the container (1) is formed of a moisture proof flexible or semiflexible foldable material;

d. the peelable ring lifting means (67) is a generally planar tab; the top lid lifting means (77) is a generally planar tab extending; the peelable ring lifting means (67) and or top lid lifting means (77) may be formed as an integral part of the peelable ring (70) or the top lid (75) or may be affixed thereto via lifting means adhesive means or mechanical means;

e. the collapsible foldable container (1) having a circular, oval, rectangular or polygonal cross-section.

* * * * *